US010223954B2

(12) United States Patent
Jin

(10) Patent No.: US 10,223,954 B2
(45) Date of Patent: Mar. 5, 2019

(54) ARRAY SUBSTRATE AND METHOD FOR MANUFACTURING THE SAME, AND DISPLAY APPARATUS

(71) Applicants: SHANGHAI AVIC OPTO ELECTRONICS CO., LTD., Shanghai (CN); TIANMA MICRO-ELECTRONICS CO., LTD., Shenzhen (CN)

(72) Inventor: Huijun Jin, Shanghai (CN)

(73) Assignees: SHANGHAI AVIC OPTO ELECTRONICS CO., LTD., Shanghai (CN); TIANMA MICRO-ELECTRONICS CO., LTD., Shenzhen (CN)

( * ) Notice: Subject to any disclaimer, the term of this patent is extended or adjusted under 35 U.S.C. 154(b) by 0 days.

(21) Appl. No.: 15/616,769

(22) Filed: Jun. 7, 2017

(65) Prior Publication Data

US 2017/0270847 A1 Sep. 21, 2017

(30) Foreign Application Priority Data

Nov. 7, 2016 (CN) ..... 2016 1 0973942

(51) Int. Cl.
*G09G 3/20* (2006.01)

(52) U.S. Cl.
CPC ..... *G09G 3/2074* (2013.01); *G09G 3/2003* (2013.01); *G09G 2300/0452* (2013.01); *G09G 2330/023* (2013.01); *G09G 2340/0457* (2013.01)

(58) Field of Classification Search
CPC .. G09G 5/003; G09G 2300/0439; G09G 3/22; G09G 3/3208; G09G 3/30; G09G 3/3225; G09G 3/3233; G09G 3/3241; G09G 3/3266; G09G 3/3275; G09G 3/3258
See application file for complete search history.

(56) References Cited

U.S. PATENT DOCUMENTS

2005/0219436 A1* 10/2005 Kwon ..... G02F 1/136209 349/44
2006/0103412 A1* 5/2006 Kimura ..... G09G 3/006 73/865.8
2006/0146222 A1* 7/2006 Kim ..... G02F 1/13394 349/56

(Continued)

FOREIGN PATENT DOCUMENTS

CN 1797132 A 7/2006
CN 103149758 A 6/2013

(Continued)

*Primary Examiner* — William Lu
(74) *Attorney, Agent, or Firm* — Alston & Bird LLP

(57) ABSTRACT

An array substrate, a method for manufacturing the array substrate and a display apparatus are provided. The array substrate includes: a display region; a common bus line disposed at all edges of the display region. The common bus line comprises a first and a second regions which are opposite to each other. A plurality of gate lines, each of which is configured to drive a row of sub pixels. The gate lines are parallel to the direction from the first region to the second region of the common bus line. At least one gate line intersects one or both of the first region and the second region of the common bus line.

19 Claims, 17 Drawing Sheets

(56) References Cited

U.S. PATENT DOCUMENTS

| | | | | |
|---|---|---|---|---|
| 2007/0146245 | A1* | 6/2007 | Goden | G09G 3/325 345/76 |
| 2008/0231577 | A1* | 9/2008 | Lin | G09G 3/3607 345/90 |
| 2010/0053053 | A1* | 3/2010 | Hsu | G09G 3/20 345/92 |
| 2013/0147779 | A1* | 6/2013 | Ochiai | G09G 5/003 345/211 |
| 2013/0307759 | A1* | 11/2013 | Jang | H01L 27/322 345/76 |
| 2015/0255487 | A1* | 9/2015 | Yoshida | G02F 1/1345 257/43 |
| 2017/0108739 | A1* | 4/2017 | Beon | G02F 1/133528 |
| 2017/0270847 | A1* | 9/2017 | Jin | G09G 3/2074 |

FOREIGN PATENT DOCUMENTS

| | | | |
|---|---|---|---|
| CN | 102636894 | A | 5/2015 |
| TW | 200839698 | A | 10/2008 |

* cited by examiner

ARRAY SUBSTRATE AND METHOD FOR MANUFACTURING THE SAME, AND DISPLAY APPARATUS

CROSS-REFERENCE TO RELATED APPLICATIONS

This application claims priority to a Chinese patent application No. CN201610973942.7, filed on Nov. 7, 2016, and entitled "Array Substrate and Method for Manufacturing the Same, and Display Apparatus", the disclosure of which is incorporated herein by reference in entirety.

TECHNICAL FIELD

The present disclosure relates to the field of display technologies, in particular to an array substrate, a method for manufacturing the array substrate and a display apparatus.

BACKGROUND

A pixel structure of an existing display apparatus usually adopts a RGB (red, green and blue) three primary color pixel design, that is, as shown in FIG. 1, each pixel is composed of a red sub pixel, a green sub pixel and a blue sub pixel. When an image is displayed by the display apparatus, the display apparatus controls each sub pixel to emit light at a corresponding luminance, whereby a desired image can be generated by visually mixing. The display apparatus with the RGB pixel structure has the advantage of high pixel independence, that is, each pixel can display all 3 colors, while the disadvantage of the display apparatus with the RGB pixel structure is relatively low display brightness. The back light must be enhanced if a higher display brightness is required, leading to an increase of power consumption. In addition, in the related art, for improving the display brightness, other sub pixels such as a white sub pixel and yellow sub pixel other than the red sub pixel, the green sub pixel and the blue sub pixel are introduced. In the case of a same pixel density (Pixels Per Inch, PPI), the introduction of other color sub pixels reduces the resolution, resulting in blurred display, insufficient sharpness and so on.

SUMMARY

An array substrate, a method for manufacturing the array substrate and a display apparatus are provided by embodiments of the present disclosure so as to solve problems of high power consumption and low display resolution in the existing display apparatus.

According to a first aspect, an embodiment of the present disclosure provides an array substrate. The array substrate includes:

a display region having a first side and a second side opposite to each other;

a common bus line disposed at a periphery of the display region and having a first region disposed at the periphery of the first side of the display region and a second region disposed at the periphery of the second side of the display region;

a plurality of sub pixels disposed in the display region and including a first color sub pixel, a second color sub pixel, a third color sub pixel and a fourth color sub pixel; and a plurality of gate lines, each of which configured to drive a respective row of the plurality of sub pixels, wherein each of odd-numbered rows of the plurality of sub pixels includes a plurality of first pixel groups, each of even-numbered rows of the plurality of sub pixels includes a plurality of second pixel groups;

each of the plurality of first pixel groups includes one first pixel unit, one second pixel unit, one third pixel unit and one fourth pixel unit which are arranged in a first order, each of the plurality of second pixel groups includes one first pixel unit, one second pixel unit, one third pixel unit and one fourth pixel unit which are arranged in a second order;

each first pixel unit includes one first color sub pixel, one second color sub pixel and one third color sub pixel; each second pixel unit includes one first color sub pixel, one second color sub pixel and one fourth color sub pixel; each third pixel unit includes one first color sub pixel, one third color sub pixel and one fourth color sub pixel; each fourth pixel unit includes one second color sub pixel, one third color sub pixel and one fourth color sub pixel;

and wherein a direction towards the second side from the first side of the display region is the same as an extending direction of the plurality of gate lines, in a direction perpendicular to the array substrate, at least one gate line merely intersects the first region of the common bus line in an insulation manner, and/or, at least one gate line merely intersects the second region of the common bus line in an insulation manner.

According to a second aspect, an embodiment of the present disclosure provides a display apparatus including the above array substrate.

According to a third aspect, an embodiment of the present disclosure provides a method for manufacturing the array substrate including:

forming a display region, wherein the display region has a first side and a second side opposite to each other, and comprises a plurality of sub pixels including a first color sub pixel, a second color sub pixel, a third color sub pixel and a fourth color sub pixel, each of odd-numbered rows of the plurality of sub pixels includes a plurality of first pixel groups, each of even-numbered rows of the plurality of sub pixels includes a plurality of second pixel groups, each of the plurality of first pixel groups includes one first pixel unit, one second pixel unit, one third pixel unit and one fourth pixel unit which are arranged in a first order, each of the plurality of second pixel groups includes one first pixel unit, one second pixel unit, one third pixel unit and one fourth pixel unit which are arranged in a second order; each first pixel unit includes one first color sub pixel, one second color sub pixel and one third color sub pixel; each second pixel unit includes one first color sub pixel, one second color sub pixel and one fourth color sub pixel; each third pixel unit includes one first color sub pixel, one third color sub pixel and one fourth color sub pixel; each fourth pixel unit includes one second color sub pixel, one third color sub pixel and one fourth color sub pixel;

forming a common bus line disposed at a periphery of the display region, wherein the common bus line has a first region disposed at the periphery of the first side of the display region and a second region disposed at the periphery of the second side of the display region; and forming a plurality of gate lines, each gate line is configured to drive a row of sub pixels, a direction towards the second side from the first side of the display region is same as an extending direction of the plurality of gate lines, in a direction perpendicular to the array substrate, at least one gate line merely intersects the first region of the common bus line in an insulation manner, and/or, at least one gate line merely intersects the second region of the common bus line in an insulation manner.

BRIEF DESCRIPTION OF DRAWINGS

In order to more clearly illustrate the technical solutions of the related art or the embodiments of the present disclosure, the accompanying drawings, which are used in the description of the related art or the embodiments, are briefly described. Apparently, the accompanying drawings are some embodiments of the present disclosure, and other accompanying drawings may be obtained based on these accompanying drawings by those skilled in the art without paying inventive work.

DETAILED DESCRIPTION

In order to make the object, the technical solutions and the advantages of the present disclosure more clear, the technical solutions of the present disclosure will be further completely described below in conjunction with the accompanying drawings and embodiments. Apparently, the embodiments disclosed herein are parts of the embodiments of the present disclosure rather than all embodiments. All other embodiments obtained by those skilled in the art based on the embodiments of the present disclosure without performing creative work fall into the protected scope of the present disclosure.

A display apparatus with RGB pixel design has a relatively low display luminance, while a display apparatus in which a white sub pixel or yellow sub pixel is introduced has a relatively higher light transmittance, and thus has a relatively high display luminance. Then, under a same display luminance, a lower power consumption is required for the display apparatus, in which the white sub pixel is introduced, to obtain the desired display luminance, while a higher power consumption is required for the display apparatus with RGB pixel design to obtain the desired display luminance (for example, increasing the luminance of the back light). However, the display apparatus in which the white sub pixel is introduced has a lower resolution, insufficient image sharpness, and blurred image. Optionally, in order to solve the problem, the pixel density is higher to increase the resolution, alternatively, a driving chip in the display apparatus drives, in a simple driving mode or a complex driving mode, two sub pixels of different colors to constitute a display dot to increase the resolution. If the driving chip adopts the complex driving mode (that is, the driving chip adopts a complex driving algorithm), the driving chip needs to compute the display content of the pixels to display an image, resulting in increased computation power consumption. If the pixel density is increased, the number of data lines and the number of scan lines will be increased, and the power consumption is also increased. Nevertheless, the manner of increasing the pixel density is difficulty to achieve due to the restriction of the producing process.

To sum up, the display apparatus generally has high power consumption for ensuring high display luminance, contrast and resolution. Therefore, the problem of the power consumption of the display apparatus is a problem to be necessarily resolved in the present disclosure. The inventor found in carrying out the present disclosure that the smaller the common bus line and the gate lines intersects, the smaller the coupling loss is. The inventor achieves a low power consumption effect by reducing the intersection of the common bus line and the gate lines.

Figure 1:
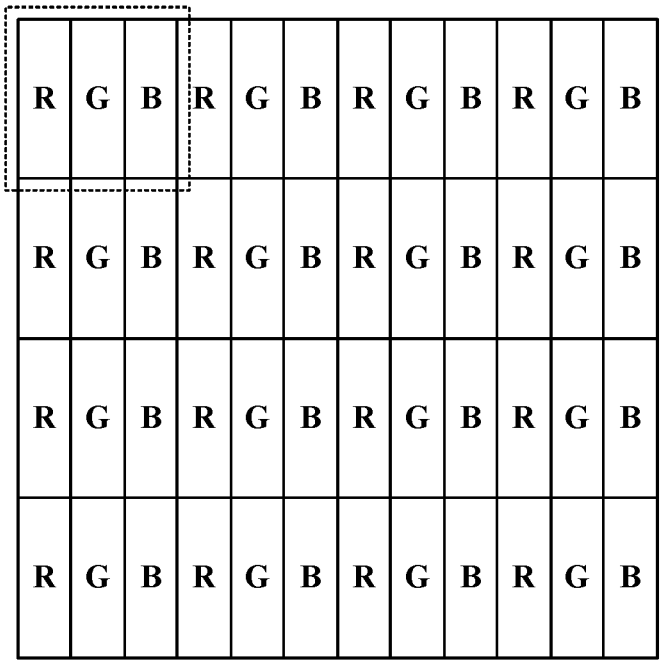
FIG. 1 is a schematic diagram showing a RGB display apparatus according to the related art.
Figure 2A:
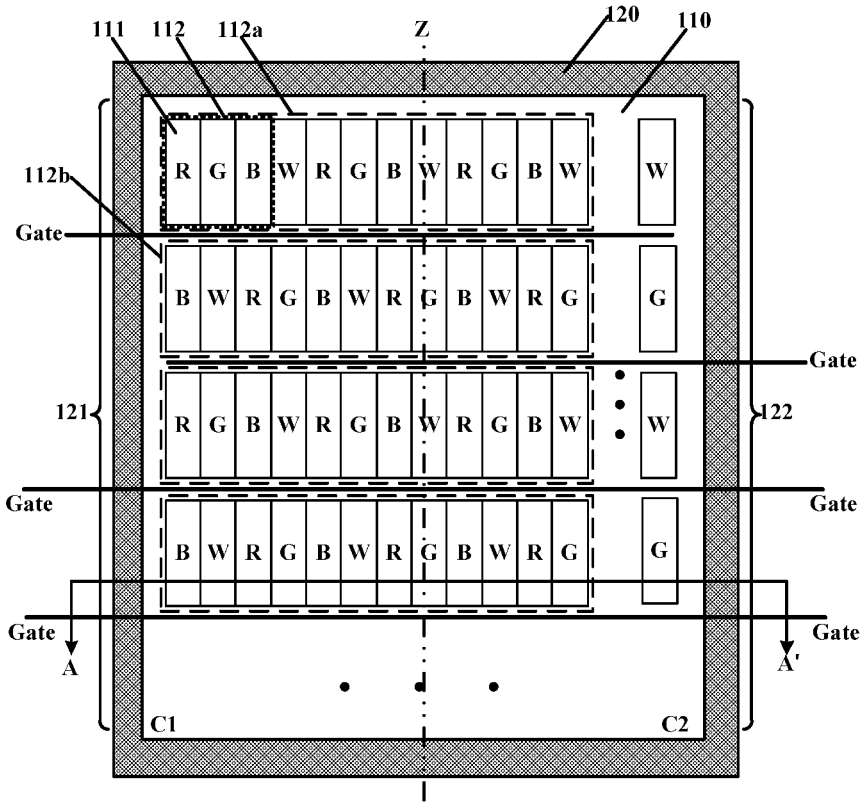
FIG. 2A is a schematic diagram showing a first type of array substrate according to an embodiment of the present disclosure.

FIG. 2A is a schematic diagram showing an array substrate according to an embodiment of the present disclosure. The array substrate of the present embodiment includes: a display region 110, a common bus line 120 located at a periphery of the display region 110, and a plurality of gate lines (Gate). The display region 110 has a first side (marked by C1) and a second side (marked by C2) opposed to each other. The display region 110 includes a plurality of sub pixels 111. The plurality of sub pixels 111 are arranged in rows and columns, and constitute a plurality of rows of first pixels and a plurality of rows of second pixels which are alternately arranged. Any adjacent two sub pixels 111 are different in color. The plurality of sub pixels 111 have four colors and constitute four types of pixel units 112, that is, a first pixel unit, a second pixel unit, a third pixel unit and a fourth pixel unit. Each pixel unit 112 includes three sub pixels of different colors. A first pixel group 112*a* is constituted by arranging the first pixel unit, the second pixel unit, the third pixel unit and the fourth pixel unit in a first order, and a second pixel group 112*b* is constituted by arranging the first pixel unit, the second pixel unit, the third pixel unit and the fourth pixel unit in a second order. Each row of the first pixel includes a plurality of first pixel groups 112*a*, and each row of second pixels includes a plurality of second pixel groups 112*b*. A first region 121 of the common bus line 120 is disposed at the periphery of the first side C1 of the display region 110, and the second region 122 of the common bus line 120 is disposed at the periphery of the second side C2 of the display region 110. Each gate line is configured to drive a row of sub pixels 111. Each gate line extends from the first side C1 toward the second side C2 of the display region 110. In a direction perpendicular to the array substrate, at least one gate line intersects but insulated from the first region 121 of the common bus line, and/or, at least one gate line intersects but insulated from the second region 122 of the common bus line The plurality of sub pixels 111 are arranged in a matrix and include a first color sub pixel, a second color sub pixel, a third color sub pixel and a fourth color sub pixel.

Each of odd-numbered rows of the plurality of sub pixels 111 includes a plurality of first pixel groups 112*a*. Each of even-numbered rows of the plurality of sub pixels 111 includes a plurality of second pixel groups 112*b*. Each of the plurality of first pixel groups 112*a* includes one first pixel unit 112, one second pixel unit 112, one third pixel unit 112 and one fourth pixel unit 112, which are arranged in a first order. Each of the plurality of second pixel groups 112*b* includes one first pixel unit 112, one second pixel unit 112, one third pixel unit 112 and one fourth pixel unit 112, which are arranged in a second order.

Each first pixel unit includes one first color sub pixel, one second color sub pixel and one third color sub pixel. Each second pixel unit includes one first color sub pixel, one second color sub pixel and one fourth color sub pixel. Each third pixel unit includes one first color sub pixel, one third color sub pixel and one fourth color sub pixel. Each fourth pixel unit includes one second color sub pixel, one third color sub pixel and one fourth color sub pixel.

As shown in FIG. 2A, in the present embodiment, the first color sub pixel is a Red sub pixel R, the second color sub pixel is a Green sub pixel G, the third color sub pixel is a Blue sub pixel B, and the fourth sub pixel is a White sub pixel W. Each first pixel unit includes one first Red sub pixel R, one Green sub pixel G and one Blue sub pixel B successively arranged. Each second pixel unit includes one White sub pixel W, one Red sub pixel and one Green sub pixel G successively arranged. Each third pixel unit includes one Blue sub pixel B, one White sub pixel W and one Red sub pixel R successively arranged. Each fourth pixel unit includes one Green sub pixel G, one Blue sub pixel B and one White sub pixel W successively arranged. The first order is one first pixel unit, one second pixel unit, one third pixel unit and one fourth pixel unit, and the second order is one third pixel unit, one fourth pixel unit, one first pixel unit and one second pixel unit. Therefore, the sub pixels in the first pixel groups 112*a* are arranged in an order that R, G, B, W, R, G, B, W, R, G, B, W; and the sub pixels in the second pixel groups 112*b* are arranged in an order that B, W, R, G, B, W, R, G, B, W, R, G.

In another embodiment, the first order is one third pixel unit, one fourth pixel unit, one first pixel unit and one second pixel unit, and the second order is one first pixel unit, one second pixel unit, one third pixel unit and one fourth pixel unit.

In another embodiment, the first color sub pixel is a Red sub pixel R, the second color sub pixel is a Green sub pixel G, the third color sub pixel is a Blue sub pixel B, and the fourth sub pixel is a Yellow sub pixel.

In the present embodiment, the array substrate includes the display region 110 having the first side C1 and the second side C2 opposed to each other. Herein, the first side C1 and the second side C2 of the display region 110 may be divided by a center line Z of the display region 110. Herein, a display part at the left side of the center line Z may be marked as the first side C1 of the display region 110, and a display part at the right side of the center line Z may be marked as the second side C2 of the display region 110. It will be understood by those skilled in the art that the first side and the second side of the display region in the present embodiment are merely reference concepts defined by people for ease of clear description, and are not specifically limited in the present disclosure. For example, in other embodiments, the first side and the second side of the display region may be defined as concepts such as a first side edge and a second side edge of the display region.

The display region 110 of the present embodiment includes a plurality of rows of first pixel and a plurality of rows of second pixel which are alternately arranged. The total number of the rows of the pixels and the number of sub pixels in each row of pixels may be set by those skilled in the art according to product requirements, which are not specifically limited in the present disclosure. Optionally, in the present embodiment, the pixels are arranged in the display region 110 according to an alternating arrangement of the first pixel, the second pixel and the first pixel. According to the above arrangement order, pixels in odd-numbered rows are the first pixels and pixels in even-numbered rows are the second pixels. It will be understood by those skilled in the art that, in other embodiments, the pixels may be arranged according to an alternating arrangement of the second pixel, the first pixel and the second pixel, then pixels in the odd-numbered rows are the second pixels and pixels in the even-numbered rows are the first pixels. The alternating arrangement of the first pixels and the second pixels is not limited in the present disclosure.

In the present embodiment, the first pixel includes the plurality of first pixel groups 112*a*, and the second pixel includes the plurality of second pixel groups 112*b*. The colors of any two adjacent sub pixels 111 are different, that is, the colors of any two adjacent sub pixels 111 in the same row are different, and the colors of any two adjacent sub pixels 111 in the same column are different. In the present embodiment, the sub pixels have four colors and constitute four types of pixel units 112, and each pixel unit 112 includes three sub pixels 111 of different colors. The four types of pixel units 112 are marked as the first pixel unit, the second pixel unit, the third pixel unit and the fourth pixel unit, respectively. The first pixel group 112*a* includes the first pixel unit to the fourth pixel unit arranged in the first order, for example, in the order of the first pixel unit, the second pixel unit, the third pixel unit and the fourth pixel unit. The second pixel group 112*b* includes the first pixel unit to the fourth pixel unit arranged in the second order, for example, in the order of the second pixel unit, the third pixel unit, the fourth pixel unit and the first pixel unit. Herein, the colors of any adjacent two sub pixels 111 are different. It will be understood by those skilled in the art that, if the sub pixels have four colors and there are more than four types of pixel units constituted by the sub pixels, on the basis that the colors of any adjacent two sub pixels are different, the relevant operator can select four types of pixel units according to product requirements and set the ordering manner of the four types of pixel units. The specific colors and the arrangement manner of the four types of pixel units are not limited in the present disclosure.

Exemplarily, the sub pixels 111 may include a red sub pixel R, a green sub pixel G, a blue sub pixel B and a white sub pixel W. The sub pixels in the first pixel group 112*a* are arranged in the first order of R, G, B, W, R, G, B, W, R, G, B, W; and the sub pixels in the second pixel group 112*b* are arranged in the second order of B, W, R, G, B, W, R, G, B, W, R, G. The pixel structure of RGBW has advantages such as high light transmittance, high luminance, low power consumption. It should be understood by those skilled in the art that the color arrangement of the sub pixels in the first pixel group and the second pixel group includes, but is not limited to the above embodiment. For example, in other embodiments, the color arrangement of the sub pixels in the first pixel group may be R, G, B, W, R, G, B, W, R, G, B, W, and the color arrangement of the sub pixels in the second pixel group may be G, B, W, R, G, B, W, R, G, B, W, R. In other embodiments, optionally, the colors of the sub pixels may include R, G, B and Y (yellow). The colors of the sub pixels, the first pixel group and the second pixel group are not specifically limited in the present disclosure.

Figure 2B:
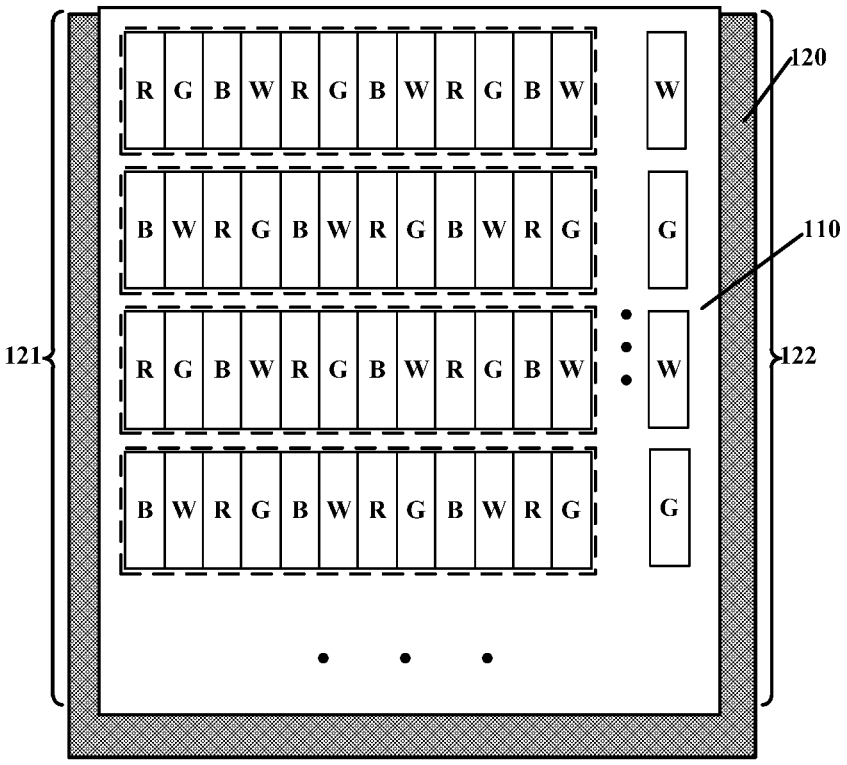
FIG. 2B is a schematic diagram showing a second type of array substrate according to an embodiment of the present disclosure.
Figure 2C:
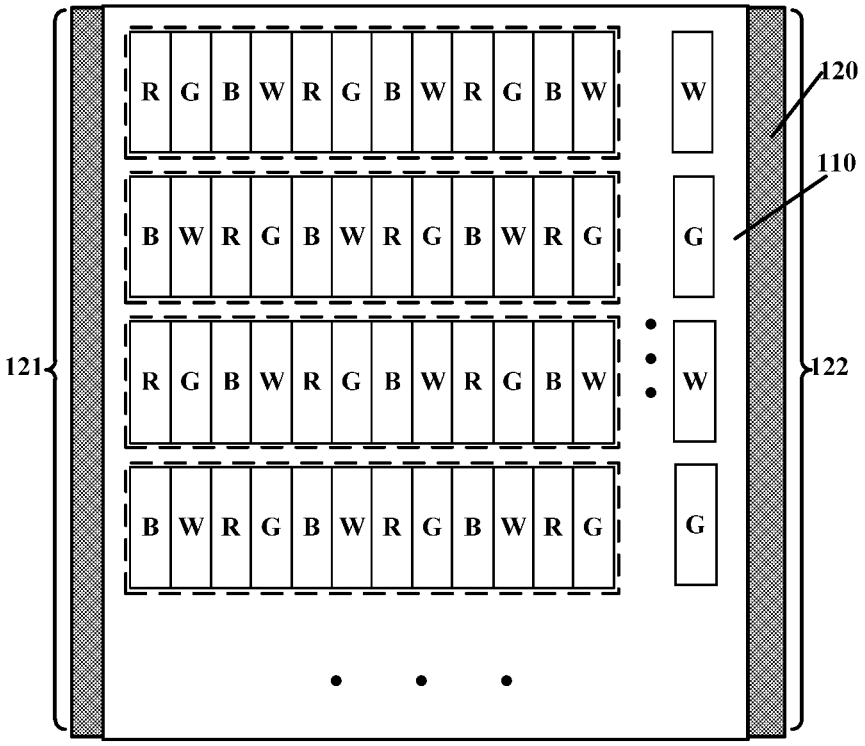
FIG. 2C is a schematic diagram showing a third type of array substrate according to an embodiment of the present disclosure.

In the present embodiment, the array substrate further includes the common bus line 120. The common bus line 120 is mainly used for providing a common potential to a common electrode (not shown) of the array substrate so as to make the voltage of the common electrode stable. The common bus line 120 includes the first region 121 of the common bus line and the second region 122 of the common bus line. In the present embodiment, optionally, the display region 110 is completed surrounded by the common bus line 120. It should be understood by those skilled in the art that, in other embodiments, optionally, as shown in FIG. 2B, the common bus line 120 includes the first region 121 of the common bus line and the second region 122 of the common bus line by which the display region 110 is half-surrounded; as shown in FIG. 2C, the display region 110 is not surrounded by the common bus line 120 and the common bus line 120 includes the first region 121 of the common bus line and the second region 122 of the common bus line. The common bus line is not specifically limited in the present disclosure. Herein, FIG. 2B is a schematic diagram showing a second type of array substrate according to an embodiment of the present disclosure, and FIG. 2C is a schematic diagram showing a third type of array substrate according to an embodiment of the present disclosure.

Figure 3A:
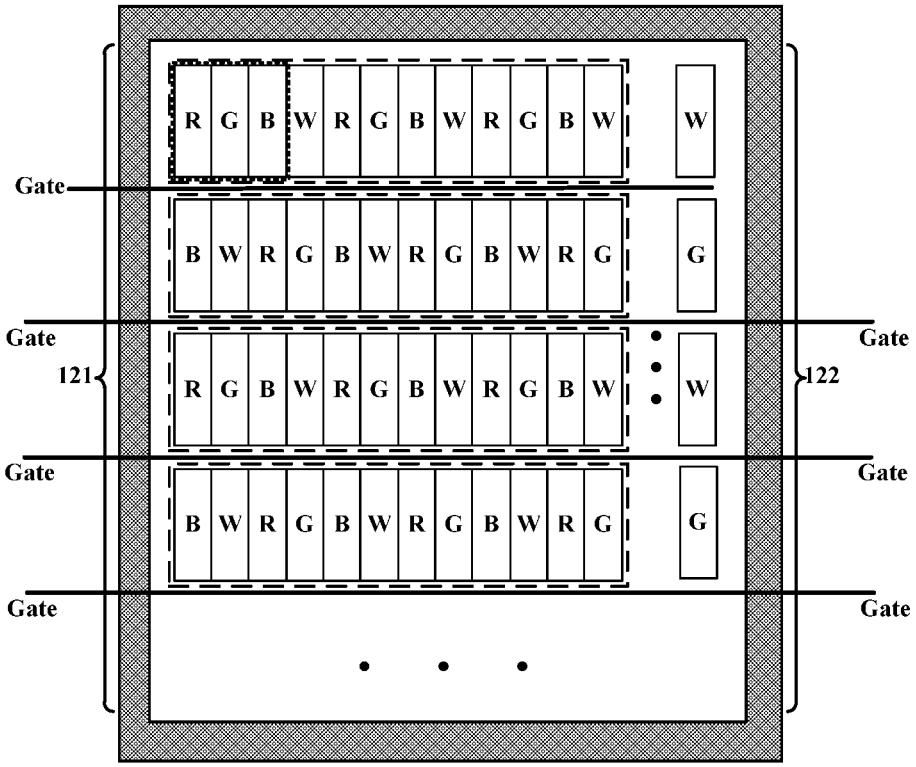
FIG. 3A is a schematic diagram showing a fourth type of array substrate according to an embodiment of the present disclosure.
Figure 3B:
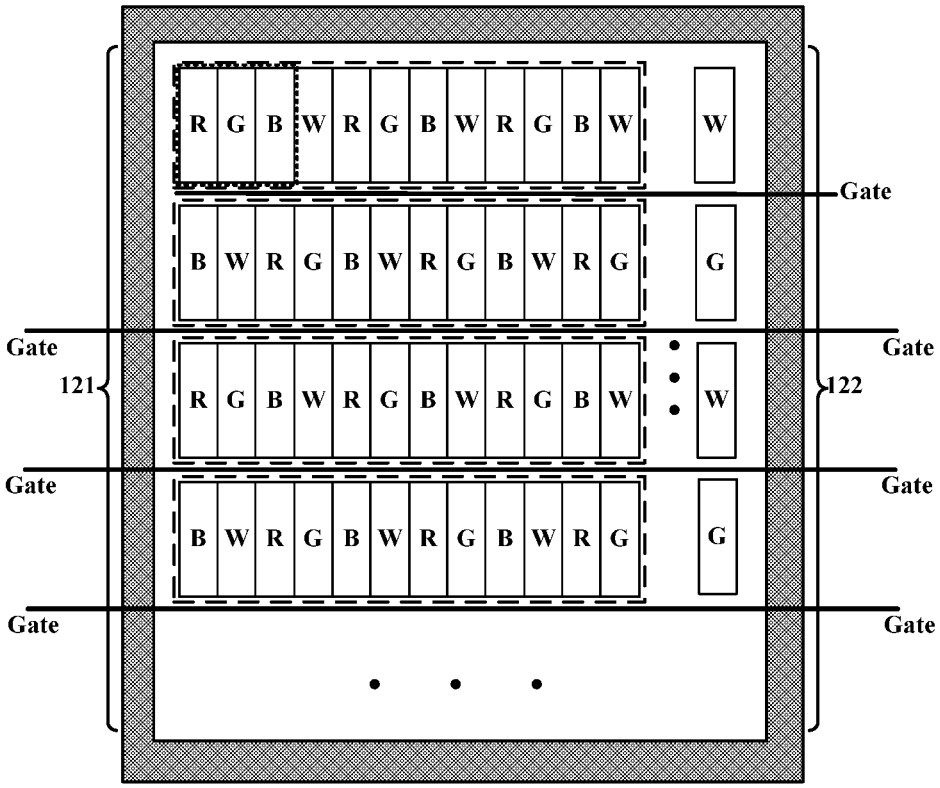
FIG. 3B is a schematic diagram showing a fifth type of array substrate according to an embodiment of the present disclosure.

In the present embodiment, the array substrate further includes a plurality of gate lines (Gate), each of which is configured to drive a row of sub pixels 111. It should be understood by those skilled in the art that, in other embodiments, optionally, a gate line is configured to drive corresponding two or more rows of pixels, the number of rows of pixels driven by the corresponding gate line is not limited in the present disclosure. In the present embodiment, at least one gate line (Gate) intersects but insulate from just one of the first region 121 and the second region 122 of the common bus line. Specifically, as shown in FIG. 2A, at least one gate line (Gate) intersects but insulates from only one of the first region 121 and second region 122 of the common bus line respectively. In other embodiments, optionally, as shown in FIG. 3A, at least one gate line (Gate) intersects only but insulates from the first region 121 of the common bus line; and as shown in FIG. 3B, at least one gate line (Gate) intersects only but insulated from the second region 122 of the common bus line. Herein, FIG. 3A is a schematic diagram showing a fourth type of array substrate according to an embodiment of the present disclosure, and FIG. 3B is a schematic diagram showing a fifth type of array substrate according to an embodiment of the present disclosure.

It should be understood by those skilled in the art that merely a local structure of the array substrate is illustrated in the embodiment, and the structure of the array substrate includes but is not limited to the above part. For example, the array substrate further includes a thin film transistor array, a driving circuit and data lines, etc. Other structures of the array substrate of the present disclosure are similar to the related art, and are not described and limited here.

As mentioned above, the sub pixels 110 in the present embodiment have four colors and each pixel unit includes three sub pixels of different colors. Compared with the existing display apparatus with RGB pixel structure, the white sub pixel is introduced in the array substrate of the present embodiment, and the display luminance and the contrast of the display apparatus are improved. Further, compared with an existing display apparatus in which the white sub pixel is introduced, three sub pixels are driven to constitute a display pot in the present embodiment, it is apparent that such pixel structure has a higher resolution. Meanwhile, in the present embodiment, at least one gate line (Gate) intersects only but insulated from the first region 121 of the common bus line, and/or, at least one gate line (Gate) intersects only but insulated from the second region 122 of the common bus line. It is apparent that the region where the common bus line 120 intersects the gate lines (Gate) is reduced, thereby decreasing the coupling loss caused by a parasitic capacitance between the gate lines (Gate) and the common bus line. Therefore, the display apparatus with the array substrate of the present embodiment has an effect of high resolution and low power consumption.

In the array substrate provided by the present embodiment, the display region thereof includes the plurality of sub pixels, each sub pixel may be a sub pixel of one of four colors. Each pixel unit includes three sub pixels of different colors. At least one gate line merely intersects the first region of the common bus line in an insulation manner, and/or, at least one gate line merely intersects the second region of the common bus line in an insulation manner. Compared with the related art, the pixel structure of the array substrate of the present embodiment has high resolution, and the region where the gate lines intersect the common bus line is reduced and the parasitic capacitance is reduced accordingly, so that the array substrate has a relatively low coupling loss. Therefore, the display apparatus with the array substrate of the present embodiment has advantages of high resolution and low power consumption.

Exemplarily, on the basis of the above technical solution, optionally, the arrangement direction of the gate lines (Gate) is perpendicular to the extending direction of the gate lines (Gate). The length of each sub pixel 111 in the arrangement direction of the gate lines (Gate) is three times of the length thereof in the extending direction of the gate lines (Gate). Accordingly, taking a situation, in which the sub pixels in the first pixel group 112*a* are arranged in R, G, B, W, R, G, B, W, R, G, B, W and the sub pixels in the second pixel group 112*b* are arranged in B, W, R, G, B, W, R, G, B, W, R, G, as an example, three sub pixels 111 of each pixel unit 112 constitute a square pixel area, the first pixel group 112*a* includes four square pixel areas and sub pixel color arrangements of the four pixel areas are RGB, WRG BWR, GBW, respectively; the second pixel group 111*b* includes four square pixel areas and sub pixel arrangements of the four pixel areas are BWR, GBW, RGB, WRG, respectively.

Figure 4:
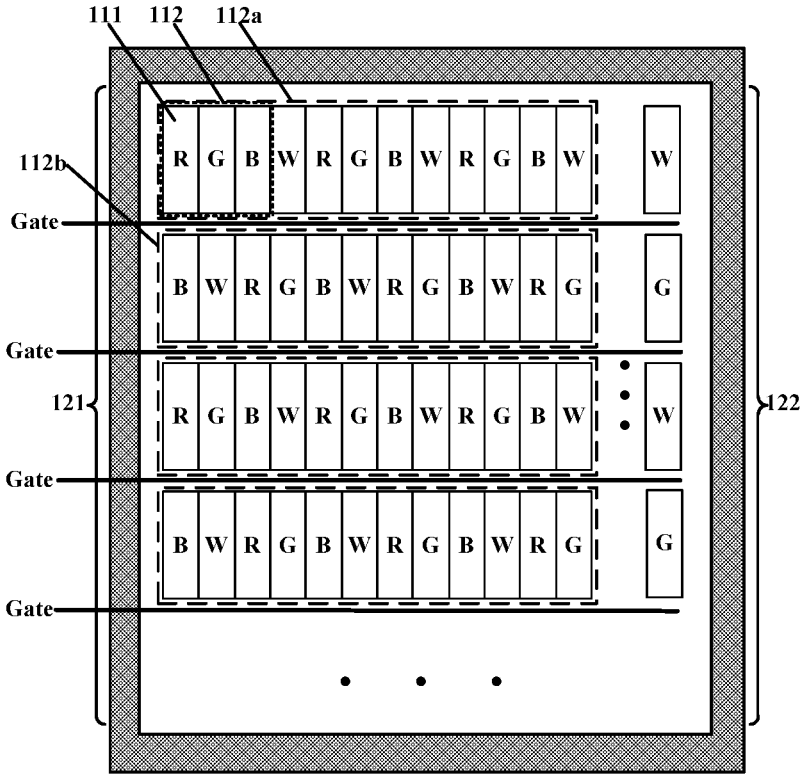
FIG. 4 is a schematic diagram showing a sixth type of array substrate according to an embodiment of the present disclosure.

Herein, three sub pixels 111 constitute a square pixel area, and the square pixel area can be served as a display dot by a driving chip for properties, and the display dot herein refers to a unit capable of displaying various colors independently. Assuming that the square pixel area constituted by three sub pixels and the existing square pixel area constituted by two sub pixels have same area, when the square pixel area constituted by three sub pixels is compared with the existing square pixel area constituted by two sub pixels, that is, a display dot constituted by two sub pixel, apparently, the pixel resolution of the pixel structure provided by the present embodiment is higher. Therefore, the problems of insufficient sharpness and blurred display are further resolved, and the display effect is improved. The power consumption of the display apparatus can be reduced substantially this way, if a structural design as shown in FIG. 4 is adopted, in which any gate line (Gate) intersects only but insulated from the first region 121 of the common bus line, or any gate line (Gate) intersects but insulated from the second region 122 of the common bus line and the length of each sub pixel 111 in the arrangement direction of the gate lines (Gate) is three times of the length thereof in the extending direction of the gate lines (Gate). It should be noted that the square pixel area is defined as the display dot because the square structure makes the distribution of the pixel units more even, and thus a problem of unclear diagonal line in the text display can be solved and the display effect is improved.

Figure 5:
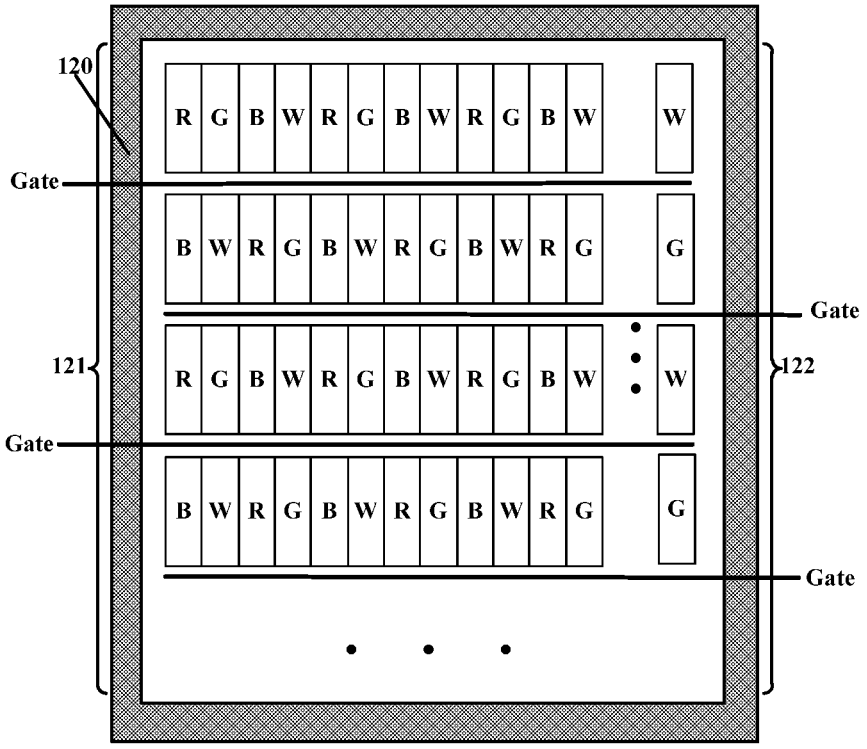
FIG. 5 is a schematic diagram showing the first type of array substrate according to another embodiment of the present disclosure.

Another embodiment of the present disclosure refers to FIG. 5, a schematic diagram showing the first type of array substrate. The difference between the array substrate of the present embodiment and the array substrate of any above embodiments lies in that, only odd-numbered gate lines (Gate) intersect but insulated from the first region 121 of the common bus line, and only even-numbered gate lines (Gate) intersect but insulated from the second region 122 of the common bus line. The similar structures in the present embodiment adopt those same reference numbers as that used in any above embodiment. In the present embodiment, each gate line (Gate) intersects the common bus line 120 only at one side, therefore, the region where the common bus line 120 intersects the gate line (Gate) in the array substrate of the present embodiment is significantly reduced, thereby reducing the parasitic capacitance between the gate line (Gate) and the common bus line 120. As a result, the array substrate is allowed to have a lower coupling loss, and the power consumption of the array substrate can be reduced while keeping high resolution.

Figure 6:
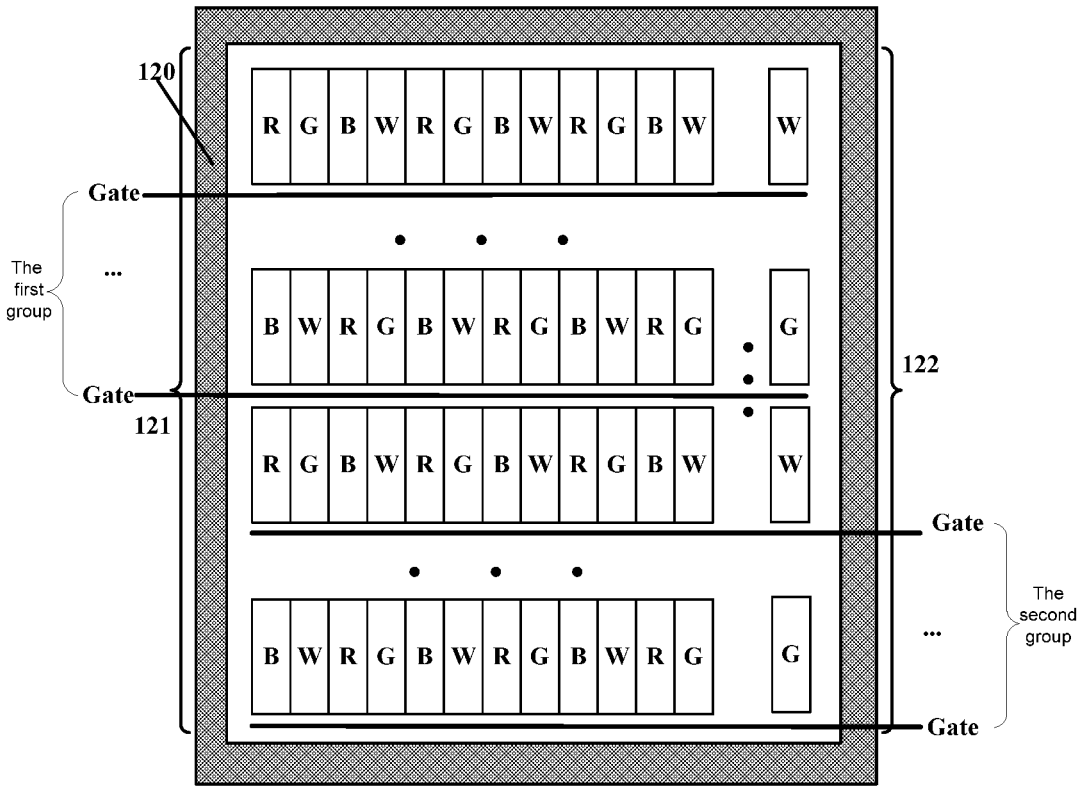
FIG. 6 is a schematic diagram showing the second type of array substrate according to another embodiment of the present disclosure.

Another embodiment of the present disclosure referring to FIG. 6 is a schematic diagram showing the second type of array substrate. The difference between such array substrate and the array substrate of any above embodiment lies in that the plurality of gate lines (Gate) are classified into a first group and a second group; each gate line (Gate) in the first group intersects only but insulated from the first region 121 of the common bus line, and each gate line (Gate) in the second group intersects only but insulated from the second region 122 of the common bus line. The similar structures in the present embodiment adopt same reference numbers as those used in the above embodiments. In the present embodiment, each gate line (Gate) intersects the common bus line 120 only at one side, therefore, the region where the common bus line 120 intersects the gate line (Gate) in the array substrate of the present embodiment is significantly reduced, thereby the parasitic capacitance between the gate line (Gate) and the common bus line 120 is also reduced. Therefore, the array substrate is allowed to have a lower coupling loss, and the power consumption of the array substrate can be reduced while keeping high resolution.

It should be understood by those skilled in the art that, optionally, the plurality of gate lines are classified into at least three groups in other embodiments, in which the gate lines in odd-numbered groups merely intersect the first region of the common bus line in an insulation manner, or, the odd-numbered gate lines merely intersect the second region of the common bus line in an insulation manner. Apparently, there are various manners of classifying the gate lines and intersecting manners of the gate lines and the common bus line, and there is no specific limitation in the present disclosure.

Figure 7:
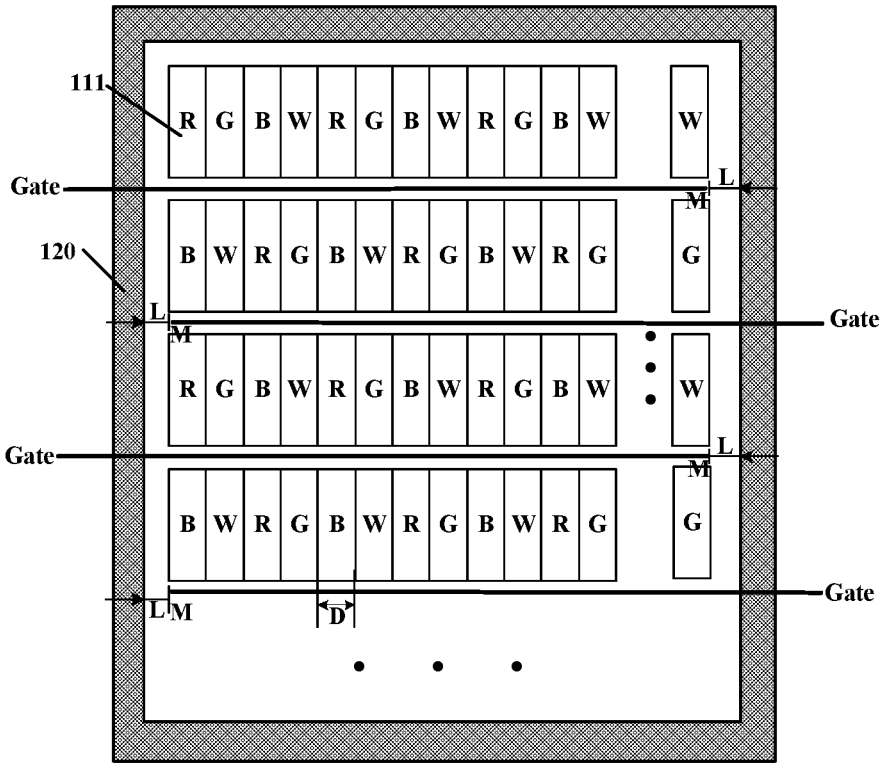
FIG. 7 is a schematic diagram showing the first type of array substrate according to yet another embodiment of the present disclosure.

Exemplarily, on the basis of the above technical solution, another embodiment of the present disclosure provides an array substrate. For clearly describing the structure of the array substrate of the present embodiment, here, the present embodiment is described by taking the arrangement of the gate lines shown in FIG. 5 as an example. Specifically, referring to FIG. 7, FIG. 7 is a schematic diagram showing the first type of array substrate according to yet another embodiment of the present disclosure. In the array substrate of the present embodiment as shown in FIG. 7, in the extending direction of the gate lines (Gate), a distance between a tip M of each gate line (Gate) and any edge of the common bus line 120 is greater than a half of a size D of the sub pixel 111. The same structures in the present embodiment adopt same reference numerals as that used in any above embodiments. The gate lines (Gate) of the array substrate are configured to output scanning signals for driving corresponding rows of pixels. The specific array substrate further includes a driving circuit (not shown). The driving circuit is electrically connected with the gate lines (Gate), and is configured to sequentially applying scanning signals to each gate line (Gate) according to a display timing. Since the gate lines (Gate) intersect only but insulated from the first region 121 of the common bus line or only but insulated from the second region 122 of the common bus line in the present embodiment, an end of the gate line away from the driving circuit has an end point, i.e., the tip M.

In the present embodiment, in the extending direction of the gate lines (Gate), the distance between the tip M of the gate line (Gate) and any edge of the common bus line 120 is greater than D/2. Apparently, a distance L between the tip M of the gate line (Gate) and the nearest edge of the common bus line 120 is greater than D/2. Herein, FIG. 7 shows the distance L between the tip M of each gate line (Gate) and the nearest edge of the common bus line 120. In the present embodiment, the distance between the tip M of each gate line (Gate) and any edge of the common bus line 120 is greater than D/2, so that the tip M of the gate line (Gate) is prevented from discharging to the common bus line 120 through point discharge. Therefore, the potential of the common bus line 120 is prevented from being affected by the point discharge of the gate line (Gate), and the static electricity of the gate line (Gate) is prevented from being introduced to the common bus line 120 so as to ensure the stability of the common bus line 120. Further, the static electricity of the common bus line 120 is prevented from being introduced to the gate line (Gate) so as to ensure the stability of the scanning signal of the gate line (Gate).

Figure 8:
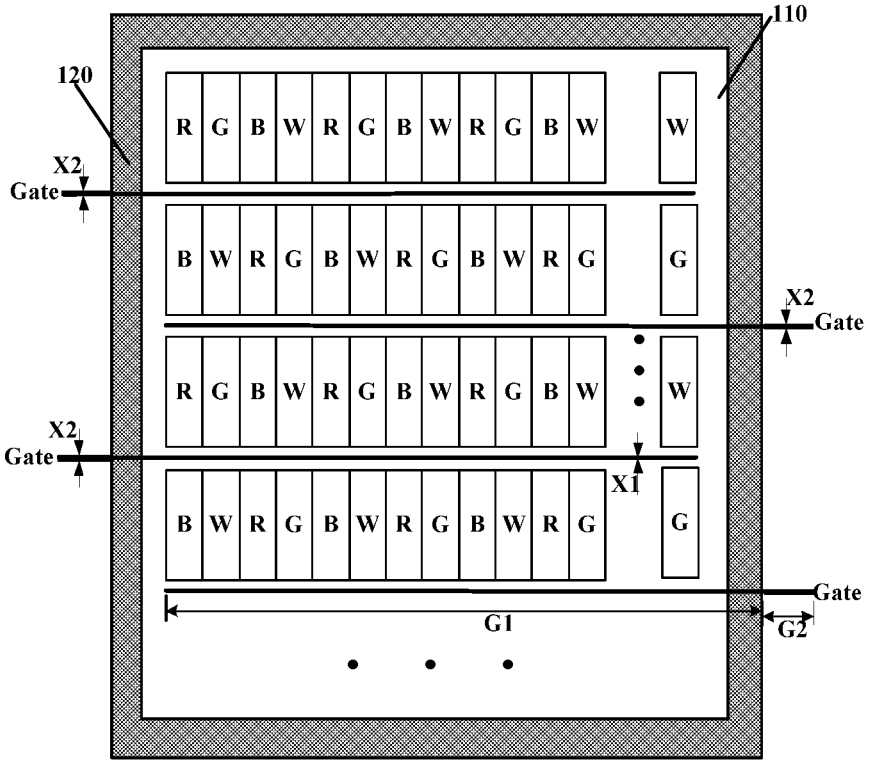
FIG. 8 is a schematic diagram showing the second type of array substrate according to yet another embodiment of the present disclosure.

Exemplarily, on the basis of the above technical solution, yet another embodiment of the present disclosure provides another array substrate. For clearly describing the structure of the array substrate of the present embodiment, here, the present embodiment is described by taking the arrangement of the gate lines shown in FIG. 5 as an example. Specifically, referring to FIG. 8, FIG. 8 is a schematic diagram showing the second type of array substrate according to yet another embodiment of the present disclosure. As shown in FIG. 8, in the array substrate of the present embodiment, the gate lines (Gate) have a first line width X1 or a second line width X2 greater than the first line width X1. A first line width region G1 of the gate line (Gate) intersects the display region 110 and the common bus line 120 in an insulation manner, and a second line width region G2 of the gate line (Gate) does not intersects the display region 110 and the common bus line 120 in an insulation manner. Optionally, the second line width X2 is greater than or equal to twice of the first line width X1. The same structures in the present embodiment adopt same reference numerals as that used in any above embodiments.

It is known that there exists parasitic capacitance at a region where the common bus line 120 intersects the gate lines (Gate) in the array substrate. For reducing the coupling loss of the array substrate due to the parasitic capacitance, optionally, the gate line (Gate) has the first line width X1 at a region where the gate line (Gate) intersects the display region 110 in an insulation manner, and has the first line width X1 at a region where the gate line (Gate) intersects the common bus line 120 in an insulation manner. The second line width region G2 of the gate line (Gate) does not intersect the display region 110 and the common bus line 120 in an insulation manner, and the gate line (Gate) has the second line width X2 in the second line width region G2, where the second line width X2 is greater than the first line width X1. Therefore, on one hand, the gate line (Gate) has the first line width X1 in the display region, so that the opaque area of the display panel can be reduced, thereby increasing the aperture ratio. On the other hand, the gate line (Gate) has the second line width X2 in regions other than the display region and a region where the gate line intersects the common bus line 120, so that the total resistance of the gate line (Gate) is effectively reduced.

It should be understood by those skilled in the art that sizes of the first line width and the second line width of the gate line can be reasonably set by relevant operators while ensuring the normal transmission of the scanning signals. The sizes of the first line width and the second line width of the gate line are not specifically limited in the present disclosure, the gate line may be provided with at least two line widths, and the line widths of the gate line are not specifically limited in the present disclosure.

Figure 9:
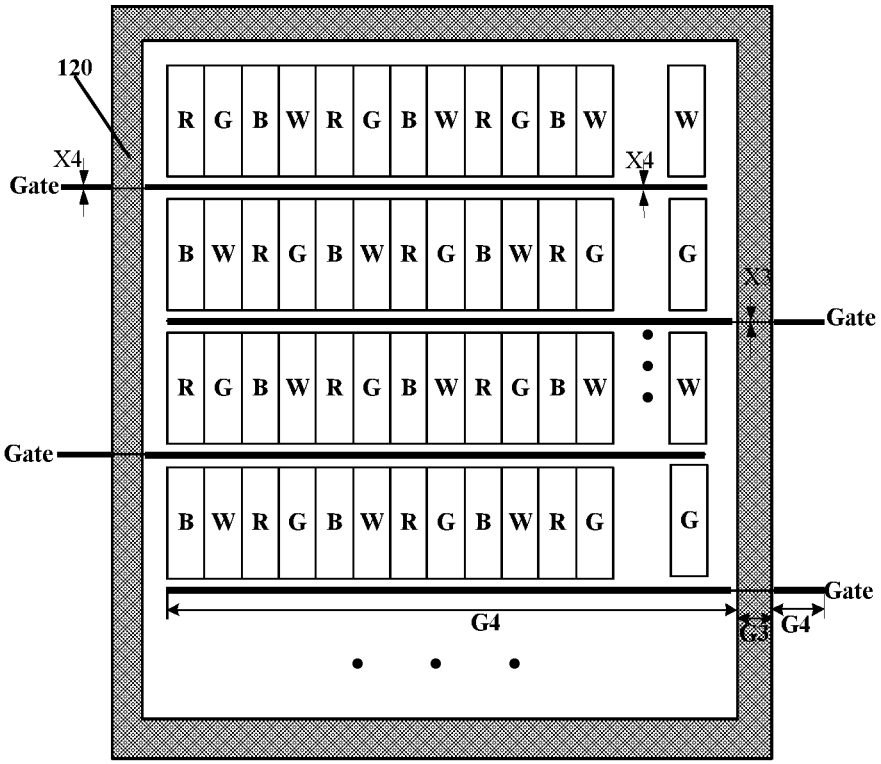
FIG. 9 is a schematic diagram showing the third type of array substrate according to yet another embodiment of the present disclosure.

Exemplarily, on the basis of the above technical solution, yet another embodiment of the present disclosure provides another array substrate. For clearly describing the structure of the array substrate of the present embodiment, here, the present embodiment is described by taking the arrangement of the gate lines shown in FIG. 5 as an example. Specifically, referring to FIG. 9, FIG. 9 is a schematic diagram showing the third type of array substrate according to yet another embodiment of the present disclosure. As shown in FIG. 9, in the array substrate of the present embodiment, for any gate line (Gate), the gate line (Gate) has a third line width X3 and a fourth line width X4. The gate line (Gate) has a third line width region G3 in which the gate line (Gate) intersects only but insulated from the common bus line 120, and a fourth line width region G4 in which the gate line intersects only but insulated from the common bus line 120. The third line width X3 is smaller than the fourth line width X4. The similar structures in the present embodiment adopt the same reference numbers as those used in any above embodiments.

Since the gate line (Gate) has the third line width X3 smaller than the fourth line width X4 in a region where the gate line (Gate) intersects but insulated from the common bus line 120 the coupling loss of the array substrate is reduced. The gate line (Gate) has the fourth line width X4 in a region where the gate line intersects but insulated from the common bus line 120, so that the stability of the scanning signals transmitted by the gate line (Gate) is ensured and the total resistance of the gate line (Gate) is effectively reduced.

Exemplarily, on the basis of the above technical solution, yet another embodiment of the present disclosure provides an array substrate. The array substrate includes a color filter layer having a plurality of color filters arranged to correspond to the plurality of sub pixels in one-to-one correspondence; and a plurality of compensation color filters, which are disposed above the common bus line, and the compensation color filters and the color filter layer are arranged in a same layer. In the direction perpendicular to the array substrate, projections of the plurality of compensation color filters and a projection of the common bus line are overlapped. It should be noted that in any of the above embodiments and corresponding drawings, R, G, B and W marked on the sub pixels indicate the colors presented by corresponding sub pixels, and the corresponding color may be obtained by filtering the light emitted from a light source through a color resistance disposed on a color film substrate opposed to the array substrate, alternatively, the corresponding color may also be obtained by filtering the light emitted from the light source through a color resistance disposed on the array substrate.

Figure 10:
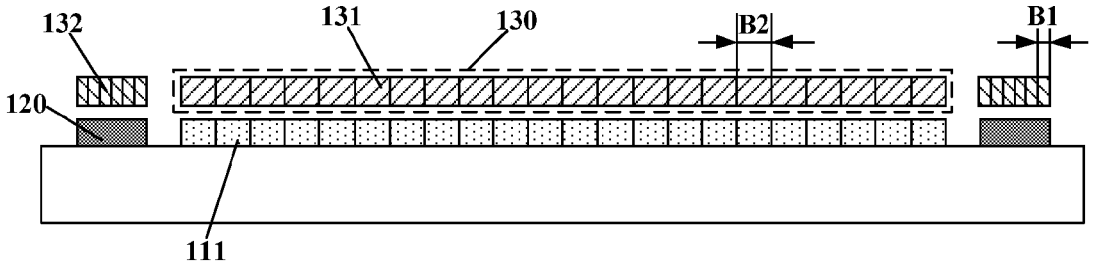
FIG. 10 is a schematic diagram showing the cross sectional view of the first type of array substrate according to yet another embodiment of the present disclosure.

For clearly describing the structure of the array substrate of the present embodiment, the present embodiment is described by taking the sectional view of the array substrate taken along A-A' shown in FIG. 2 as an example. Specifically, referring to FIG. 10, FIG. 10 is a schematic diagram showing the first type of array substrate according to yet another embodiment of the present disclosure. As shown in FIG. 10, the array substrate of the present embodiment further includes: a color filter layer 130 including a plurality of color filters 131 arranged to correspond to the plurality of sub pixels 111 in one-to-one correspondence; and a plurality of compensation color filters 132 disposed above the common bus line 120, the compensation color filters 132 and the color filter layer 130 are arranged in a same layer. In the direction perpendicular to the array substrate, projections of the plurality of compensation color filters 132 and a projection of the common bus line 120 are overlapped. The same structures in the present embodiment adopt same reference numerals as that used in any above embodiments. It should be understood by those skilled in the art that structures such as the sub pixels and the common bus line are disposed on a substrate of the array substrate. The substrate is provided with structures such as a thin film transistor array and a driving circuit, etc. The structure of the substrate is similar to that in the related art, and is not described and limited herein.

In the present embodiment, the plurality of color filters 131 in the color filter layer 130 are arranged in one to one correspondence with the plurality of the sub pixels 111. For example, the arrangement sequence of sub pixels in a row of pixels is: R, G, B, W, R, G, B, W, R, G, B, W, then the arrangement sequence of the color filters corresponding to the row of pixels is: red, green, blue, white, red, green, blue, white, red, green, blue, white. In an embodiment of the present disclosure, optionally, the color filter layer is disposed on the color film substrate of the display apparatus. Optionally, the color filter layer may be disposed on the array substrate of the display apparatus. The location of the color filter layer is not specifically limited in the present disclosure. In the present embodiment, optionally, the color filter layer 130 is disposed on the array substrate of the display apparatus.

The array substrate of the present embodiment further includes the compensation color filters 132 disposed above the common bus line 120, and the compensation color filters 132 and the color filter layer 130 are arranged in a same layer. The plurality of compensation color filters 132 can also be served as color filtering units. The compensation color filters 132 differ from the color filters 131 in that the compensation color filters 132 are disposed above the common bus line 120 and do not correspond to the sub pixels 111. Therefore, the color filter layer 130 plays the main role in color filtering function in the display apparatus. The advantage of disposing the compensation color filters 132 in the present embodiment lies in that the compensation color filters 132 and the color filter layer 130 are arranged in the same layer. As a result, a region of the display apparatus where the common bus line 120 is located and the display region of the display apparatus have same and uniform cell thickness. Compared with the related art, it is not necessary to provide a pad on the common bus line for supporting the display apparatus. The rubbing alignment is liable to be abruptly changed, while the pad does not alleviate the problem of the abrupt change in the alignment. On the contrary, the compensation color filters 132 in the present embodiment are capable of alleviating the abrupt change in the alignment.

In the present embodiment, in the direction perpendicular to the array substrate, projections of the plurality of compensation color filters 132 and the projection of the common bus line 120 are overlapped. The compensation color filters 132 can also be served as color filtering units, then, disposing the compensation color filters 132 further has the following advantages: the compensation color filters 132 are disposed above the common bus line 120, and the common bus line 120 is disposed at the periphery of the display region, so that, after the display apparatus being formed, the edge portion of the display region may have the same display effect as that of the display region through the compensation color filters 132.

For better improving the display effect of the edge portion of the display region, optionally, the compensation color filters 132 have the same color distribution as that of the sub pixels 111. For example, n compensation color filters 132 are provided above the first region 121 of the common bus line. In this case, if the pixels in the first pixel group 112*a* are arranged in an order of R, G, B, W, R, G, B, W, R, G, B, W, the color arrangement of the n compensation color filters 132 located in a same row as the first pixel group 112*a* is as follows: if n=1, the color of the compensation color filter 132 is optionally W; if n=2, the colors of the two compensation color filters 132 are optionally B, W; if n=3, the colors of the three compensation color filters 132 are optionally G, B, W; if n=4, the colors of the four compensation color filters 132 are optionally R, G, B, W; if n=5, the colors of the five compensation color filters 132 are optionally W, R, G, B, W. It will be understood by those skilled in the art that the color arrangement of the compensation color filters is not limited to the above arrangements, and may be set by associated operators according to product requirements.

In the present embodiment, optionally, in the extending direction of the gate lines (Gate), a width B1 of the compensation color filter 132 is one-third of a width B2 of the color filter 131 of the color filter layer 130. Since the width of the compensation color filter 132 is small, a plurality of compensation color filters 132 can be provided above the first region 121 of the common bus line and the second region 122 of the common bus line, thereby improving the display effect of the edge portion of the display region.

Exemplarily, on the basis of the above technical solution, yet another embodiment of the present disclosure provides an array substrate. The array substrate differs from the array substrate in any of the above embodiments in that: the array substrate further includes a common electrode layer arranged to be stacked with and insulated from a film in which the plurality of gate lines are located. Those skilled in the art will comprehend the stacked structure of the common electrode layer and the gate lines in the array substrate, which is not illustrated and described in the present embodiment.

In an embodiment of the present disclosure, optionally, the common electrode layer is not electrically connected with the common bus line and the common bus line is grounded, then the main function of the common bus line is to output the static electricity from the array substrate so as to prevent the static electricity of the array substrate from entering the gate line, which affects the electrical performances of the gate lines. In an embodiment of the present disclosure, optionally, the common electrode layer is electrically connected with the common bus line via a through hole, then the main function of the common bus line is to provide a common potential for the common electrode layer. The common electrode layer, the common bus line and the structural relationship there between are not limited in the present disclosure, and the related operator can set the structural relationship between the common electrode layer and the common bus line according to the functions of the product.

Figure 11:
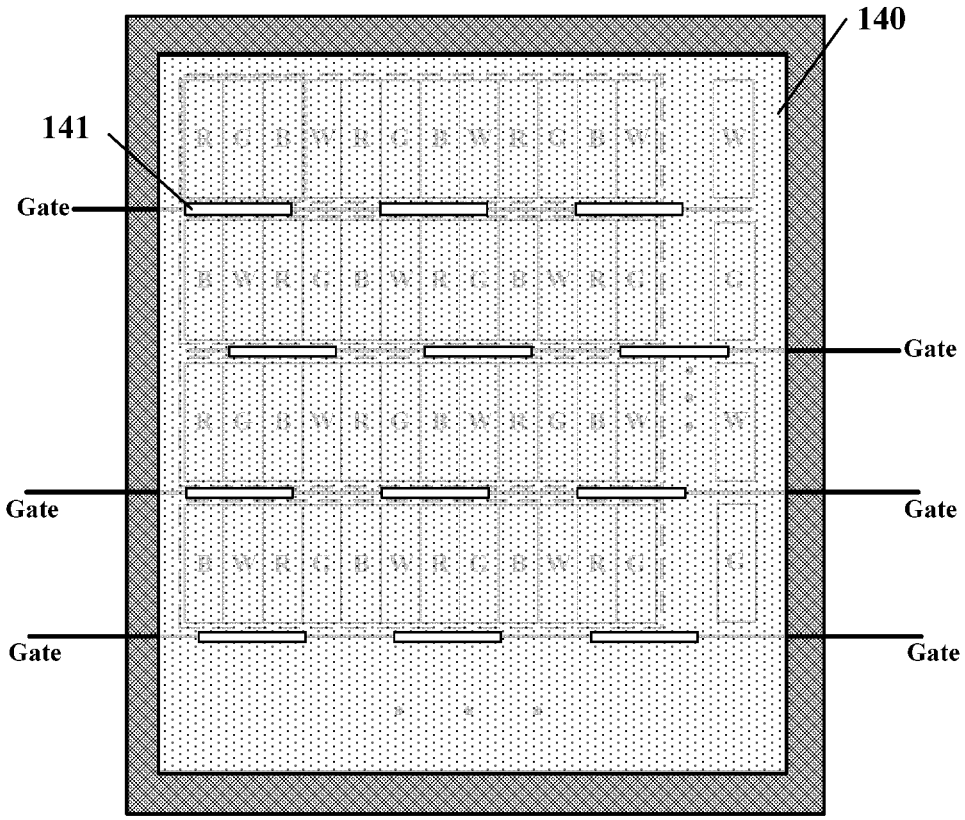
FIG. 11 is a schematic diagram showing the second type of array substrate according to yet another embodiment of the present disclosure.

For clarifying the structure of the array substrate of the present embodiment, the array substrate of the present embodiment is described by taking the arrangement of the gate lines shown in FIG. 2A as an example. Specifically, referring to FIG. 11, FIG. 11 is a schematic diagram showing the second type of array substrate according to yet another embodiment of the present disclosure. As shown in FIG. 11, the array substrate of the present embodiment further includes a common electrode layer 140 arranged to be stacked with and insulated from a film in which the plurality of gate lines (Gate) are disposed. The same structures in the present embodiment adopt same reference numerals used in any above embodiments. It is known that the gate lines (Gate) and the common electrode layer 140 are overlapped, thus parasitic capacitances are formed in a region where the gate lines (Gate) and the common electrode layer 140 are overlapped. The parasitic capacitances will cause the gate lines (Gate) to generate a coupling loss and cause the common electrode layer 140 to generate a coupling loss. Therefore, in order to reduce the parasitic capacitances between the common electrode layer 140 and the gate lines (Gate), in the present embodiment, optionally, in the direction perpendicular to the array substrate, a slit 141 is provided at the region of the common electrode layer 140 where the common electrode layer 140 and the gate line (Gate) are stacked and insulated from each other. The number and shape of the slit are not specifically limited in the present disclosure. The parasitic capacitance between the common electrode layer 140 and the gate line (Gate) is reduced due to the slit 141 in the region where the common electrode layer 140 and the gate line (Gate) are overlapped in an insulation manner. Accordingly, the coupling between the common electrode layer 140 and the gate line (Gate) is reduced, the coupling loss of the common electrode layer 140 and the gate line (Gate) is reduced, and the effect of reducing the power consumption of the array substrate and the display apparatus is achieved. It will be understood by those skilled in the art that the slit may also be provided in the region where the common bus line and the gate line are overlapped to reduce the coupling loss, which is not illustrated and described herein.

Figure 12:
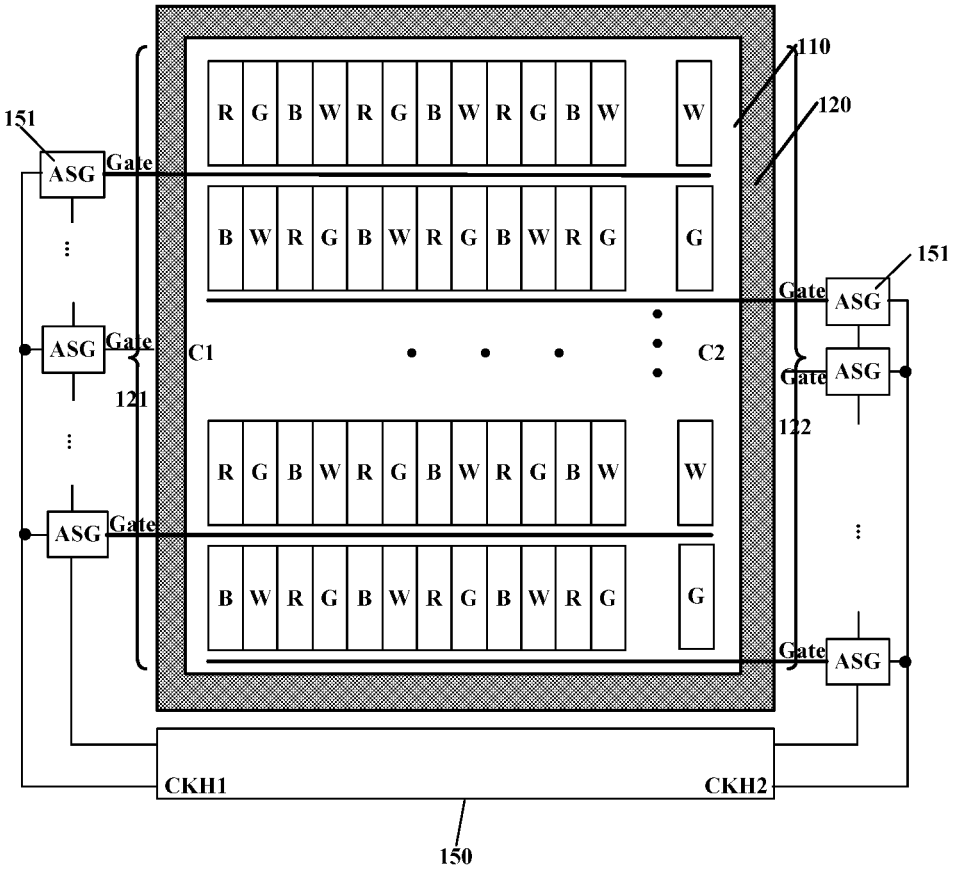
FIG. 12 is a schematic diagram showing the third type of array substrate according to yet another embodiment of the present disclosure.

Exemplarily, on the basis of the above technical solution, an embodiment of the present disclosure further provides an array substrate, which is described herein by taking the array substrate shown in FIG. 5 as an example. As shown in FIG. 12, the array substrate of the present embodiment further includes: a gate driver 150, configured to scan the plurality of gate lines (Gate) in a progressive scanning manner; and a plurality of shift registers 151 arranged in one to one correspondence with the plurality of gate lines (Gate). An output terminal of each shift register 151 is electrically connected with a corresponding gate line (Gate). An input terminal of each shift register 151 is electrically connected with a diving terminal of the gate driver 150. The shift registers 151 disposed at the periphery of the first side C1 of the display region 110 are cascaded to one another and a control terminal of an initial shift register 151 is electrically connected with a first driving control terminal CKH1 of the gate driver 150. The shift registers 151 disposed at the periphery of the second side C2 of the display region 110 are cascaded to one another and a control terminal of an initial shift register 151 is electrically connected with a second driving control terminal CKH2 of the gate driver 150. The same structures in the present embodiment adopt same reference numerals as that used in any above embodiments. In the present embodiment, optionally, an Amorphous Silicon Gate (ASG) technique is adopted for driving. In ASG, the shift register is constituted by amorphous silicon thin film transistor (A-Si TFT), therefore, the shift register 151 of the present embodiment is referred to as ASG for short.

In the present embodiment, the shift registers 151 drive the gate lines (Gate) from a single side, the gate lines (Gate) only intersect the first side 121 of the common bus line or the gate lines (Gate) only intersect the second side 122 of the common bus line. Compared with the related art, the area of the region where the gate lines (Gate) intersect the common bus line 120 is significantly reduced, and the coupling loss of the array substrate is significantly reduced, thereby reducing the power consumption of the display apparatus.

Figure 13:
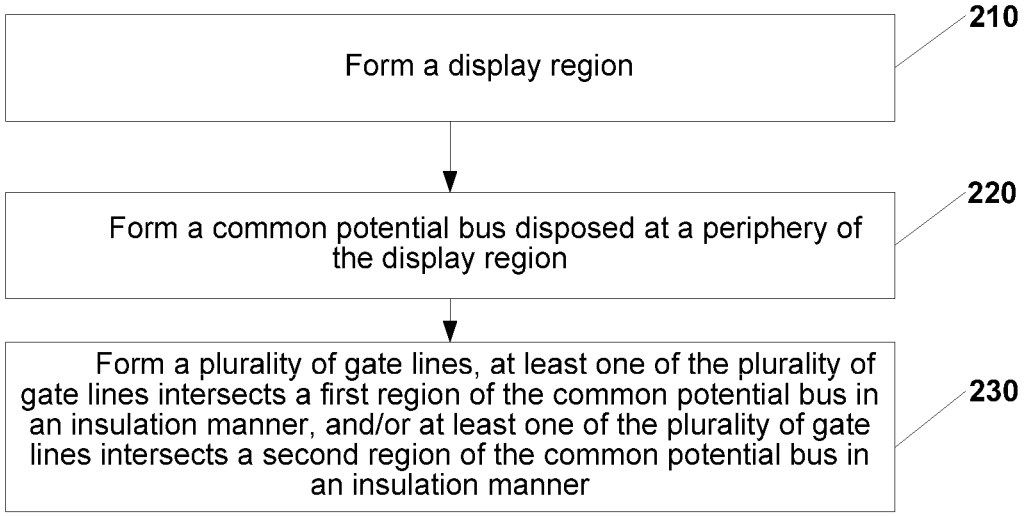
FIG. 13 is a schematic diagram showing a method for manufacturing the array substrate according to an embodiment of the present disclosure.

An embodiment of the present disclosure further provides a method for manufacturing an array substrate. The method may be applied to the array substrate of any of the above embodiments. As shown in FIG. 13, the method includes Step 210 to Step 230.

In step 210, a display region is formed.

The display region of the array substrate has a first side and a second side opposed to each other. The display region includes a plurality of sub pixels. The plurality of sub pixels are arranged in rows and columns and constitute rows of first pixel and rows of second pixel which are alternately arranged. Any adjacent two sub pixels are different in color. Each sub pixel is of one of four colors, the plurality of sub pixels constitute the following four types of pixel units: a first pixel unit, a second pixel unit, a third pixel unit and a fourth pixel unit. Each pixel unit includes three sub pixels of different colors; a first pixel group is constituted by arranging the first pixel unit, the second pixel unit, the third pixel unit and the fourth pixel unit in a first order, a second pixel group is constituted by arranging the first pixel unit, the second pixel unit, the third pixel unit and the fourth pixel unit in a second order, each row of first pixel includes a plurality of first pixel groups and each row of second pixel includes a plurality of second pixel groups.

In the present embodiment, each pixel unit in the display region includes three sub pixels of different colors. Compared with the existing display apparatus with the RGB pixel structure, a white sub pixel is introduced in the array substrate of the present embodiment, and the display luminance and the contrast of the display apparatus are improved. Compared with an existing display apparatus in which the white sub pixel is introduced, three sub pixels are driven to constitute one display pot in the present embodiment, it is apparent that the pixel structure has a higher resolution.

In step 220, a common bus line located at a periphery of the display region is formed. A first region of the common bus line is disposed at the periphery of the first side of the display region and a second region of the common bus line is disposed at the periphery of the second side of the display region.

In step 230, a plurality of gate lines are formed. Each of the plurality of gate lines is configured to driving a row of sub pixels, a direction towards the second side from the first side of the display region is the same as an extending direction of the gate lines. In a direction perpendicular to the array substrate, at least one gate line merely intersects the first region of the common bus line in an insulation manner, and/or, at least one gate line merely intersects the second region of the common bus line in an insulation manner.

Compared with the related art, the area of the region where the gate lines intersect the common bus line is reduced in the present embodiment, and the parasitic capacitances between the gate lines and the common bus line are reduced accordingly. The present embodiment has a lower coupling loss, and the power consumption of the array substrate is reduced accordingly.

Exemplarily, on the basis of the above method, optionally, the sub pixels includes a red sub pixel R, a green sub pixel G, a blue sub pixel B and a white sub pixel W. The sub pixels in the formed first pixel group are arranged in the first order of R, G, B, W, R, G, B, W, R, G, B, W; and the sub pixels in the formed second pixel group are arranged in the second order of B, W, R, G, B, W, R, B, W, R, G.

Exemplarily, on the basis of the above method, optionally, an arrangement direction of the gate lines is perpendicular to the extending direction of the gate lines, and a length of each sub pixel in the arrangement direction of the gate lines is three times of a length thereof in the extending direction of the gate lines. In this embodiment, the height size of each sub pixel in the arrangement direction of the gate line is three times of the width size thereof in the extending direction of the gate line, and the three sub pixels in each pixel unit constitute a display dot. Compared with the existing display apparatus in which the white sub pixel is introduced, the pixel structure of the present embodiment is of higher resolution. Therefore, the problem of insufficient sharpness in existing apparatus will not occur, thereby alleviating the phenomenon of blurred display.

The pixel structure of the array substrate of the present embodiment has a high resolution and improves the display effect. The area of the region where the gate lines intersect the common bus line in the array substrate of the present embodiment is reduced, and the parasitic capacitances are reduced accordingly. Therefore, the array substrate has a lower coupling loss, and the corresponding power demand for the array substrate is reduced.

It will be understood by those skilled in the art that the process flow of the array substrate includes, but is not limited to, the above set sequence. The associated operator can set the process flow of the array substrate according to the product requirements. The process flow of the array substrate is not limited in the present disclosure. The array substrate further includes other structures such as thin film transistor arrays, and other structures are similar to those of the related art and are not specifically limited in the present disclosure.

Figure 14:
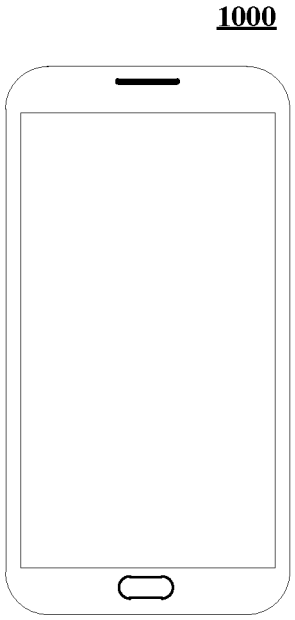
FIG. 14 is a schematic diagram showing a display apparatus according to an embodiment of the present disclosure.

On the basis of any of above embodiments, an embodiment of the present disclosure further provides a display apparatus. FIG. 14 is a schematic diagram showing the display apparatus according to an embodiment of the present disclosure. As shown in FIG. 14, the display apparatus 1000 includes the array substrate described in any of the above embodiments. The display apparatus 1000 may be a mobile, tablet, smart watch, wearable display device and the like. It should be understood that the display apparatus 1000 may further include known structures such as a back light source, a light guide plate, a liquid crystal layer, an alignment layer and a protection glass, etc., which are not described here. Specifically, the display apparatus 1000 includes the display panel having the array substrate described in any of the above embodiments. Those skilled in the art will comprehend that the array substrate is only a partial structure of the display apparatus, and the display panel further includes structures such as a color film substrate or a light emitting device, etc. The structure of the display panel is not limited in the embodiments of the present disclosure. Optionally, the display apparatus may be a liquid crystal display or an organic light emitting display in the present embodiment. The display apparatus of the present disclosure drives the pixels by means of a driving chip, which can drive the pixels by a simple driving mode or a complex driving mode. Regardless of the driving mode of the driver chip, the display apparatus provided by the embodiment of the present disclosure can achieve the effect of low power consumption while taking into account the high resolution display effect.

It is to be noted that the above is only embodiments of the present disclosure and the technical principle applied thereto. It will be understood by those skilled in the art that the present disclosure is not limited to the specific embodiments described herein. Those skilled in the art can make various other apparent changes, rearrangements and substitutions without departing from the scope of the disclosure. Thus, although the present disclosure has been described in detail with reference to the above embodiments, the present disclosure is not limited to the above embodiments, and the present disclosure may be embodied in other equivalent forms without departing from the scope of the present disclosure. The scope of the present disclosure is determined by the scope of the appended claims.

What is claimed is:

1. An array substrate, comprising:

a display region;

a common bus line disposed on edges of the display region, wherein the common bus line has a first region and a second region opposite to each other;

a plurality of sub pixels disposed in rows in the display region, each comprising a first color sub pixel, a second color sub pixel, a third color sub pixel and a fourth color sub pixel;

a plurality of parallel gate lines divided into odd-numbered and even-numbered gate lines, configured to drive even and odd numbered rows of the plurality of sub pixels;

a color filter layer, wherein the color filter layer comprises a plurality of color filters aligned to the plurality of sub pixels in a one to one correspondence; and a plurality of compensation color filters configured in a same layer as the color filter layer, wherein the plurality of compensation color filters are disposed above the common bus line, wherein projections of the plurality of compensation color filters on the array substrate overlaps a projection of the common bus line;

wherein each odd-numbered row of the plurality of sub pixels includes a plurality of first pixel groups, each even-numbered row of the plurality of sub pixels includes a plurality of second pixel groups;

wherein each of the plurality of first pixel groups comprises one first pixel unit, one second pixel unit, one third pixel unit and one fourth pixel unit arranged in a first order; wherein each of the plurality of second pixel groups comprises arrange in a second order one first pixel unit, one second pixel unit, one third pixel unit and one fourth pixel unit arranged in a second order; wherein each first pixel unit comprises one first color sub pixel, one second color sub pixel and one third color sub pixel; wherein each second pixel unit comprises one first color sub pixel, one second color sub pixel and one fourth color sub pixel; each third pixel unit comprises one first color sub pixel, one third color sub pixel and one fourth color sub pixel; each fourth pixel unit comprises one second color sub pixel, one third color sub pixel and one fourth color sub pixel; and wherein the plurality of gate lines extend in a direction perpendicular to the first and the second regions of the common bus line, wherein the plurality of gate lines are insulated from the common bus line; and wherein at least one of the plurality of gate lines intersects one or both of the first and second regions of the common bus line.

2. The array substrate according to claim 1, wherein the first color sub pixel is a Red sub pixel, the second color sub pixel is a Green sub pixel, the third color sub pixel is a Blue sub pixel and the fourth color sub pixel is a White sub pixel, and wherein the first order is one first pixel unit, one second pixel unit, one third pixel unit and one fourth pixel unit, and the second order is one third pixel unit, one fourth pixel unit, one first pixel unit and one second pixel unit.

3. The array substrate according to claim 2, wherein an arrangement direction of the gate lines is perpendicular to the extending direction of the gate lines, and wherein a length of each sub pixel in the arrangement direction of the gate lines is three times of a length of the sub pixel in the extending direction of the gate lines.

4. The array substrate according to claim 3, wherein every pixel unit has three sub pixels, wherein the said three sub pixels in each first pixel unit, each second pixel unit, each third pixel unit, or each fourth pixel unit constitute a square pixel region, wherein each first pixel unit includes one Red sub pixel, one Green sub pixel and one Blue sub pixel successively arranged; wherein each second pixel unit includes one White sub pixel, one Red sub pixel and one Green sub pixel successively arranged; wherein each third pixel unit includes one Blue sub pixel, one White sub pixel and one Red sub pixel successively arranged; and wherein each fourth pixel unit includes one Green sub pixel, one Blue sub pixel and one White sub pixel successively arranged.

5. The array substrate according to claim 1, wherein the odd-numbered gate lines intersect only the first region of the common bus line, and the even-numbered gate lines intersect only the second region of the common bus line.

6. The array substrate according to claim 1, wherein the plurality of gate lines are further divided into a first group and a second group, each gate line in the first group intersects only the first region of the common bus line, and each gate line in the second group intersects only the second region of the common bus line.

7. The array substrate according to claim 1, wherein a distance between a tip of each gate line and any edge of the common bus line is greater than a half of the sub pixel's width parallel to the gate lines.

8. The array substrate according to claim 1, wherein at least one of the plurality of gate lines comprises a first portion and a second portion, wherein the first portion has a narrower linewidth than the second portion, and wherein the first portion intersects the common bus line, and the second portion is outside the display region.

9. The array substrate according to claim 8, wherein the said linewidth of the second portion is at least twice the linewidth of the first portion.

10. The array substrate according to claim 1, wherein at least one of the plurality of gate lines comprises a third portion and a fourth portion, wherein a linewidth of the third portion is narrower than the fourth portion, wherein the third portion intersects the common bus line, and the fourth portion does not intersect the common bus line.

11. The array substrate according to claim 1, wherein a width of at least one of the plurality of compensation color filters is one-third of a width of at least one of the plurality of color filters, in the direction parallel to the gate lines.

12. The array substrate according to claim 1, further comprising a common electrode layer, wherein the common electrode layer overlaps and insulated from a layer containing the plurality of gate lines.

13. The array substrate according to claim 12, wherein a slit is provided in a region where the plurality of gate lines intersect the common electrode layer.

14. The array substrate according to claim 1, further comprising:

a gate driver, configured to scan the plurality of gate lines in a progressive scanning manner; and a plurality of shift registers arranged in one-to-one correspondence with the plurality of gate lines, wherein an output terminal of each of the plurality of shift registers is electrically connected with a corresponding gate line, an input terminal of each of the plurality of shift registers is electrically connected with a driving terminal of the gate driver;

wherein the shift registers, wherein a control terminal of an initial shift register is electrically connected with a first driving control terminal of the gate driver, are disposed at the periphery of the first side of the display region are cascaded, and the shift registers, wherein a control terminal of an initial shift register is electrically connected with a second driving control terminal of the gate driver, are disposed at the periphery of the second side of the display region are cascaded.

15. A display apparatus, comprising an array substrate, wherein the array substrate comprises:

a display region;

a common bus line disposed on all edges of the display region, wherein the common bus line has a first region and a second region opposite to each other;

a plurality of sub pixels disposed in rows in the display region, each comprising a first color sub pixel, a second color sub pixel, a third color sub pixel and a fourth color sub pixel;

a plurality of parallel gate lines divided into odd-numbered and even-numbered gate lines, configured to drive even and odd numbered rows of the plurality of sub pixels;

a color filter layer, wherein the color filter layer comprises a plurality of color filters aligned to the plurality of sub pixels in a one to one correspondence; and a plurality of compensation color filters configured in a same layer as the color filter layer, wherein the plurality of compensation color filters are disposed above the common bus line, wherein projections of the plurality of compensation color filters on the array substrate overlaps a projection of the common bus line;

wherein each odd-numbered row of the plurality of sub pixels includes a plurality of first pixel groups, each even-numbered row of the plurality of sub pixels includes a plurality of second pixel groups;

wherein each of the plurality of first pixel groups comprises one first pixel unit, one second pixel unit, one third pixel unit and one fourth pixel unit arranged in a first order; wherein each of the plurality of second pixel groups comprises arrange in a second order one first pixel unit, one second pixel unit, one third pixel unit and one fourth pixel unit arranged in a second order; wherein each first pixel unit comprises one first color sub pixel, one second color sub pixel and one third color sub pixel; wherein each second pixel unit comprises one first color sub pixel, one second color sub pixel and one fourth color sub pixel; each third pixel unit comprises one first color sub pixel, one third color sub pixel and one fourth color sub pixel; each fourth pixel unit comprises one second color sub pixel, one third color sub pixel and one fourth color sub pixel; and wherein the plurality of gate lines extend in a direction perpendicular to the first and the second regions of the common bus line, wherein the plurality of gate lines are insulated from the common bus line; and wherein at least one of the plurality of gate lines intersects one or both of the first and second regions of the common bus line.

16. A method for manufacturing the array substrate according to claim 1, comprising:

forming a display region, wherein the display region has a first side and a second side opposite to each other, and comprises a plurality of sub pixels including a first color sub pixel, a second color sub pixel, a third color sub pixel and a fourth color sub pixel, each of odd-numbered rows of the plurality of sub pixels includes a plurality of first pixel groups, each of even-numbered rows of the plurality of sub pixels includes a plurality of second pixel groups, each of the plurality of first pixel groups includes one first pixel unit, one second pixel unit, one third pixel unit and one fourth pixel unit which are arranged in a first order, each of the plurality of second pixel groups includes one first pixel unit, one second pixel unit, one third pixel unit and one fourth pixel unit which are arranged in a second order; each first pixel unit includes one first color sub pixel, one second color sub pixel and one third color sub pixel; each second pixel unit includes one first color sub pixel, one second color sub pixel and one fourth color sub pixel; each third pixel unit includes one first color sub pixel, one third color sub pixel and one fourth color sub pixel; each fourth pixel unit includes one second color sub pixel, one third color sub pixel and one fourth color sub pixel;

forming a common bus line disposed at all edges of the display region, wherein the common bus line has a first region and a second region, wherein the first and second regions are opposite to each other; and forming a plurality of gate lines, wherein the plurality of gate lines are insulated from the common bus line, each gate line is configured to drive a row of sub pixels, a direction towards the second side from the first side of the display region is same as an extending direction of the plurality of gate lines, in a direction perpendicular to the array substrate, wherein at least one of the plurality of gate lines intersects one or both of the first region and the second region of the common bus.

17. The method according to claim 16, wherein the first color sub pixel is a Red sub pixel, the second color sub pixel is a Green sub pixel, the third color sub pixel is a Blue sub pixel and the fourth color sub pixel is a White sub pixel, wherein the first order is one first pixel unit, one second pixel unit, one third pixel unit and one fourth pixel unit, and the second order is one third pixel unit, one fourth pixel unit, one first pixel unit and one second pixel unit.

18. The method according to claim 16, wherein an arrangement direction of the gate lines is perpendicular to the extending direction of the gate lines, a length of each sub pixel in the arrangement direction of the gate lines is three times of a width of each sub pixel in the extending direction of the gate lines.

19. An array substrate, comprising:

a display region;

a common bus line disposed on edges of the display region, wherein the common bus line has a first region and a second region opposite to each other;

a plurality of sub pixels disposed in rows in the display region, each comprising a first color sub pixel, a second color sub pixel, a third color sub pixel and a fourth color sub pixel; and a plurality of parallel gate lines divided into odd-numbered and even-numbered gate lines, configured to drive even and odd numbered rows of the plurality of sub pixels, wherein each odd-numbered row of the plurality of sub pixels includes a plurality of first pixel groups, each even-numbered row of the plurality of sub pixels includes a plurality of second pixel groups, wherein each of the plurality of first pixel groups comprises one first pixel unit, one second pixel unit, one third pixel unit and one fourth pixel unit arranged in a first order; wherein each of the plurality of second pixel groups comprises arrange in a second order one first pixel unit, one second pixel unit, one third pixel unit and one fourth pixel unit arranged in a second order; wherein each first pixel unit comprises one first color sub pixel, one second color sub pixel and one third color sub pixel; wherein each second pixel unit comprises one first color sub pixel, one second color sub pixel and one fourth color sub pixel; each third pixel unit comprises one first color sub pixel, one third color sub pixel and one fourth color sub pixel; each fourth pixel unit comprises one second color sub pixel, one third color sub pixel and one fourth color sub pixel, wherein the plurality of gate lines extend in a direction perpendicular to the first and the second regions of the common bus line, wherein the plurality of gate lines are insulated from the common bus line, wherein at least one of the plurality of gate lines intersects one or both of the first and second regions of the common bus line, wherein at least one of the plurality of gate lines comprises a first portion and a second portion, and wherein the first portion has a narrower linewidth than the second portion, wherein the first portion intersects the common bus line, and the second portion is outside the display region; and wherein the linewidth of the second portion is at least twice the linewidth of the first portion.

* * * * *